United States Patent [19]

Marschke

[11] 4,200,276

[45] Apr. 29, 1980

[54] SHINGLING AND STACKING OF CONVEYED SHEET MATERIAL

[75] Inventor: Carl R. Marschke, Phillips, Wis.

[73] Assignee: Marquip, Inc., Phillips, Wis.

[21] Appl. No.: 906,059

[22] Filed: May 15, 1978

[51] Int. Cl.[2] ..... B65H 29/66

[52] U.S. Cl. ..... 271/279; 271/202; 93/93 C

[58] Field of Search ..... 271/202, 258, 265, 270, 271/64, 172, 259, 203; 93/93 C

[56] References Cited

U.S. PATENT DOCUMENTS

| | | | |
|---|---|---|---|
| 3,772,971 | 11/1973 | Dutro | 93/93 C |
| 4,140,310 | 2/1979 | Schröter | 271/265 |

*Primary Examiner*—Richard A. Schacher

*Attorney, Agent, or Firm*—Andrus, Sceales, Starke & Sawall

[57] ABSTRACT

A conveyor system wherein sheets are conveyed from a cutter or the like at a given speed, are increased in speed before passing through a diverter, are slowed down after passing through a shingling nip to thereby overlap them, and then normally proceed at the latter speed to a stacker which is adapted to stack a fixed number of sheets before discharging the stack. A sheet sensor is disposed upstream of the diverter to count the number of sheets and, when the requisite number of sheets have passed, triggers the cycle for ultimate discharge of all downstream sheets in a single stack. The first phase of the discharge cycle includes speeding up of the conveyor line downstream of the shingling nip to move the downstream sheets away from those upstream which will be disposed in the next succeeding stack. As the trailing end of the group of fast-moving downstream sheets passes selected points, the shingle conveyor sections upstream thereof are slowed to partially delay the sheets which will form the next stack in their movement down the conveyor. When all of the sheets destined for the stack are in the stacker, the stacker is actuated to discharge the stack and thereupon the conveyors downstream of the shingling nip are slowly returned to their original normal speed for conveying the sheets which will form the next succeeding stack.

13 Claims, 15 Drawing Figures

FROM CORRUGATOR KNIFE
SPEED-UP CONVEYOR
DIVERTER SECTION
SHEET SENSOR
VACUUM CONVEYOR
ENCODER SHAFT
SHINGLING NIP
REJECT SHEET SENSOR
ACCUMULATING CONVEYOR
SCRAP DISCHARGE
STACK INFEED CONVEYOR
TO FIG. 1B

FROM FIG. 1A
STACK INFEED CONVEYOR
SCRAP DISCHARGE
STACK LIFT MOTOR
STACK LIFT
STACKER
LIFT SENSOR
STACK LIFT MOTOR

SHINGLING AND STACKING OF CONVEYED SHEET MATERIAL

PRIOR ART OF INTEREST

U.S. Pat. No. 3,390,731, Schierbeck July 2, 1968
U.S. Pat. No. 3,565,423, Kluth Feb. 23, 1971

BACKGROUND AND SUMMARY OF THE INVENTION

This invention relates to shingling and stacking of conveyed sheet material, such as corrugated paperboard and the like.

In the manufacture of paperboard products such as boxes, the paperboard is often played out from a source such as a large roll, cut into separate sheets, stacked and then suitably further processed into the desired product. The entire operation is necessarily accomplished at high speed because of the large volume of products to be made. The conveying devices between the different stations must operate swiftly and accurately.

It has been previously been suggested, as in the above-identified U.S. Pat. No. 3,565,423, to utilize a shingling device upstream of a sheet stacker to shorten the length of the total conveyor needed.

It is an aim of the present invention to provide an improved concept for conveying, shingling and stacking sheet material wherein a pre-determined number of sheets are to be stacked at a time and then discharged before the next stack forming is commenced. It is a further aim of the invention to speed up the transfer of the shingled sheets to the stacker and to start the stacker discharge cycle once the total number of conveyed sheets to be stacked in a single stack have passed a selected point on the line. It is also an aim of the present invention to hold back the upstream sheets on and downstream of the shingling conveyor, without stopping their movement, while the stacker is discharging. In addition, it is an aim of the invention to accomplish the above-mentioned aims automatically.

The invention contemplates utilization of a conveyor system wherein sheets are conveyed from a cutter or the like at a given speed, are increased in speed before passing through a diverter, are slowed down after passing through a shingling nip to thereby overlap them, and then normally proceed at the latter speed to a stacker which is adapted to stack a fixed number of sheets before discharging the stack.

In accordance with one aspect of the invention, a sheet sensor is disposed upstream of the diverter to count the number of sheets and, when the requisite number of sheets have passed, triggers the cycle for ultimate discharge of all downstream sheets in a single stack.

In accordance with another aspect of the invention, the first phase of the discharge cycle includes speeding up of the conveyor line downstream of the shingling nip to move the downstream sheets away from those upstream which will be disposed in the next succeeding stack.

In accordance with a further aspect of the invention, a sheet position sensing means is utilized, and as the trailing end of the group of fast-moving downstream sheets passes selected points, the shingle conveyor sections upstream thereof are slowed to partially delay the sheets which will form the next stack in their movement down the conveyor. When all of the sheets destined for the stack are in the stacker, the stacker is actuated to discharge the stack and thereupon the conveyors downstream of the shingling nip are slowly returned to their original normal speed for conveying the sheets which will form the next succeeding stack. All of this is accomplished automatically.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figures 1A, 1B:
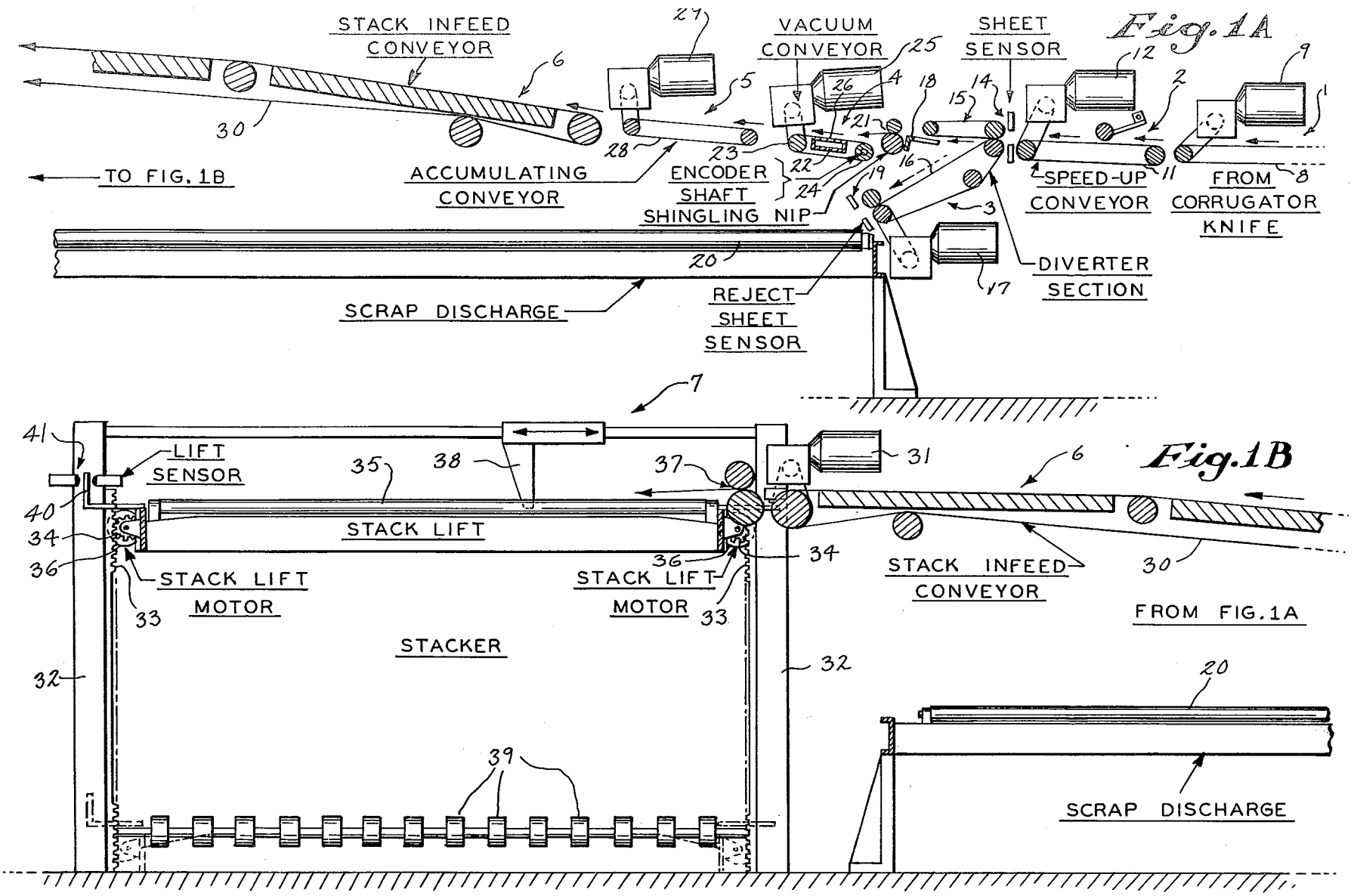
FIGS. 1A and 1B are schematic in-line views of a device adapted to operate in accordance with the various aspects of the invention.

As best shown in FIGS. 1A, 1B and 2–4, the concept of the invention may be embodied in a device which includes, in line, an input conveyor section 1, a speed-up conveyor section 2, a diverter section 3, a vacuum conveyor section 4, an accumulating conveyor section 5, a stack infeed conveyor section 6 and a sheet stacker 7.

Figure 2:
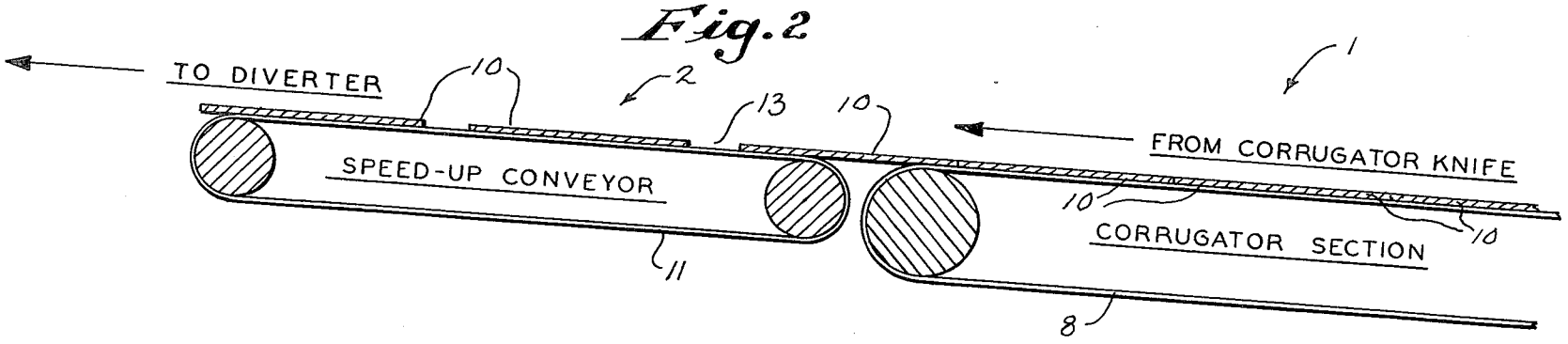
FIGS. 2, 3 and 4 are enlarged schematic fragmentary in-line views of the various conveyor sections and showing the sheets passing therealong.
Figure 3:
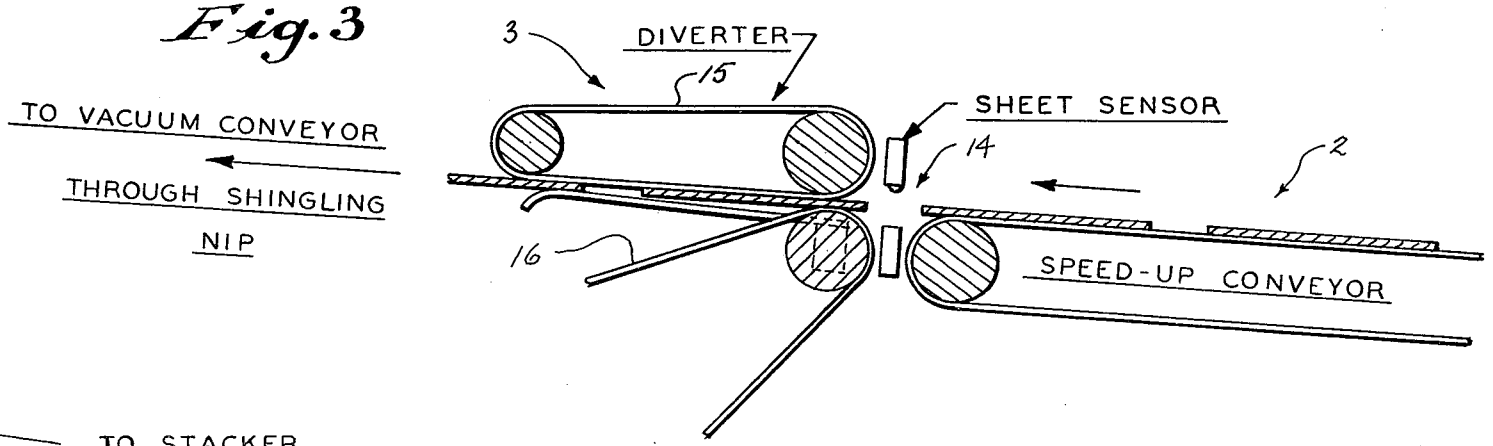

Input conveyor section 1 includes an endless belt 8 which is suitably driven by a motor 9, with belt 8 forming the discharge end of any suitable sheet processing mechanism, not shown, which includes a device for severing a continuous roll into separate individual sheets 10. As shown in FIG. 2, the sheets coming down belt 8 are in abutting end-to-end relationship. For purposes of illustration, and in the preferred embodiment, belt 8 is driven at a constant speed of about 600 ft./min.

Speed-up conveyor section 2 includes an endless belt 11 which is suitably driven by a motor 12 and which receives sheets from section 1 for further transfer to section 3. It is desirable to separate sheets 10 from their abutting relationship so that they are suitably spaced apart for further handling downstream. For this purpose, motor 12 is designed to drive belt 11 at a speed faster than belt 8 to thereby pull the sheets apart and provide a space 13 therebetween. In the preferred embodiment, belt 11 is adapted to be driven at about 110% of the speed of input belt 8, or about 660 ft./min.

A sheet sensor 14, such as a photoelectric device is disposed at the discharge end of speed-up section 2, for purposes to be described.

Diverter section 3 is adapted to receive the separated and speeded up sheets from section 2 and to remove the line any damaged or otherwise undesirable sheets. Section 3 may be of the type disclosed in the co-pending patent application of Carl R. Marschke entitled "Diverter For Conveyed Sheet Material," Ser. No. 804,632, filed June 8, 1977, and assigned to a common assignee. The diverter may include an upper primary conveyor belt 15 and a lower secondary conveyor belt 16 which are suitably driven by a motor 17 and which normally diverge. A guide member 18 is utilized and undesirable sheets are transferred downwardly onto conveyor belt 16 where the pass through a reject sheet sensor 19 onto scrap discharge rollers 20.

Motor 17 is adapted to drive conveyor belts 15 and 16 at the same constant speed as belt 11 is driven, that is, about 660 ft./min.

Sheets 10 which are not diverted pass from conveyor belt 15 through a pair of rollers which form a shingling nip 21 and to vacuum conveyor section 4.

Section 4 includes a plurality of side-by-side endless belts 22 trained about front and rear shafts 23, 24 respectively, and with a motor 25 adapted to drive the belts through shaft 23. A transversely elongated vacuum box 26 is disposed between the upper and lower flights of belts 22, is connected to any suitable source of negative pressure, not shown, and has opening means 27 in its upper wall to apply a vacuum or negative pressure to sheets 10 which descend thereupon after passing through shingling nip 21.

Figure 4:
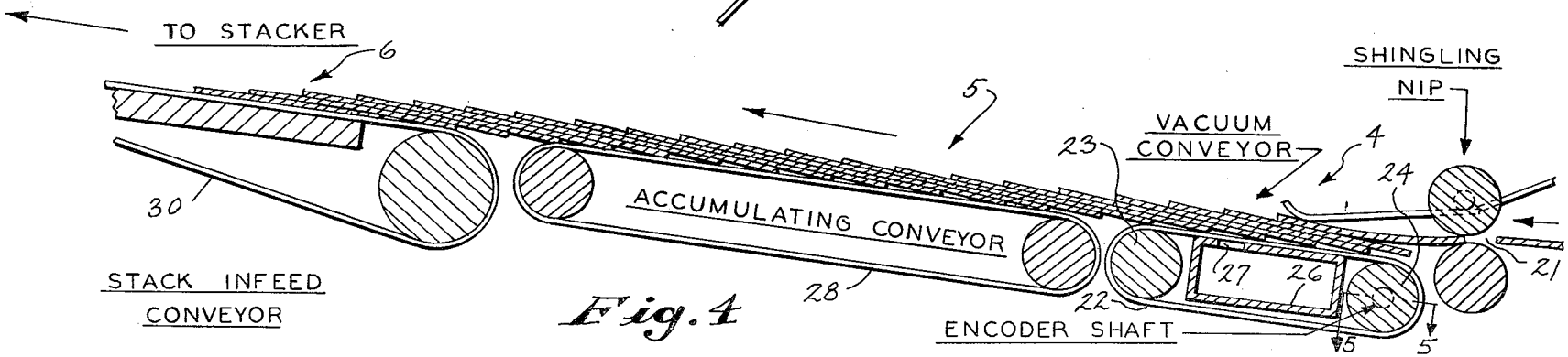

Motor 25 is adapted at all times to be driven at a substantially slower speed than motors 9 and 12 so that belts 22 will travel slower than belts 8, 11 and 15. During normal operating conditions, the speed of belts 22 should preferably be about 25% of the speed of input conveyor belt 8, or in the preferred example, about 150 ft./min. This slower speed, together with the vacuum, immediately decelerates the oncoming sheets 10, as shown in FIG. 4, so that they overlap or shingle. In the example, the 1 to 4 speed reduction causes sheet overlap of approximately 75%.

During normal operation, the shingled sheets then pass onwardly to accumulating conveyor section 5 which includes an endless belt 28 which is suitably driven by a motor 29 which normally drives the belt at the same speed as belts 22 are driven. The sheets then pass onwardly to stack infeed conveyor section 6 which also comprises an endless belt 30 suitably driven at the same speed by motor 31. Thus, normally, the shingled sheets pass from section 4 through sections 5 and 6 at the same reduced speed until they finally reach sheet stacker 7.

Figure 6:
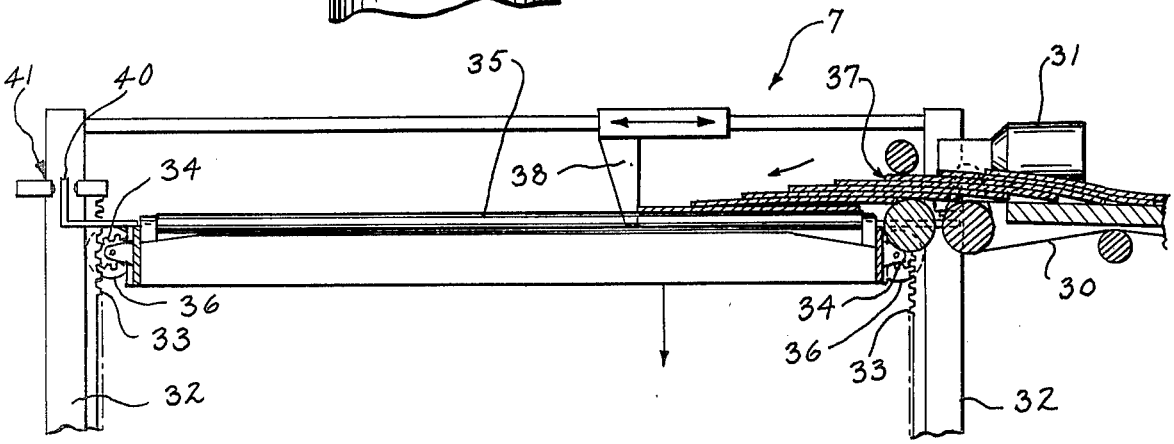
FIG. 6 is a fragmentary view of the stacker at the commencement of formation of a particular stack of sheets.
Figure 7:
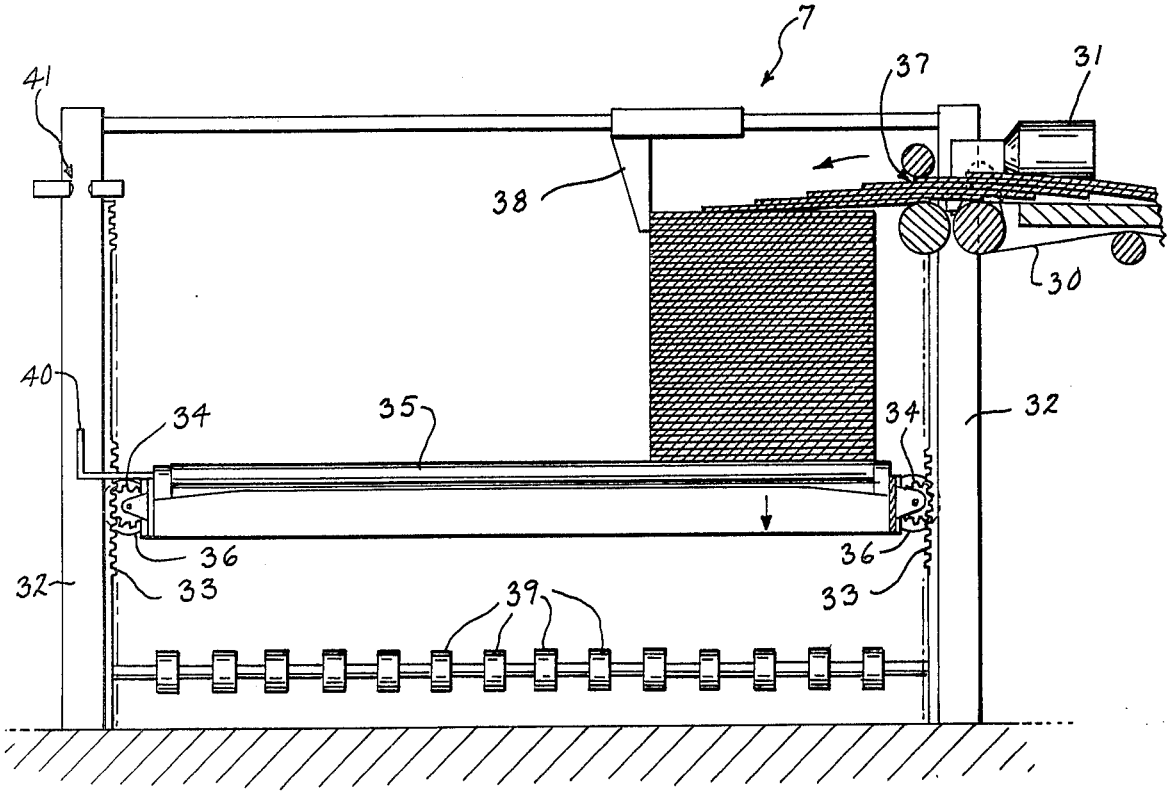
FIG. 7 is a view of the stacker when the stack has increased in height.

As best seen in FIGS. 1B, 6 and 7, stacker 7 includes a pair of vertical frame members 32 having racks 33 thereon. Racks 33 in turn mesh with pinions 34 mounted on a roller-type stacker platform 35 and which are adapted to be driven by individually connected motors 36 to move the platform vertically within the frame. A nip 37 is disposed at the entrance to stacker 7 and through which the shingled sheets pass.

At the start of formation of a stack of sheets, for example 100 in number, platform 35 is at its upper position shown in FIGS. 1B and 6. As the sheets enter the stacker, they engage a horizontally adjustable backstop 38 which aligns the sheets into an end justified vertical stack. As sheets continue through nip 37, motors 36 operate to gradually lower platform 35 so that, although the stack gets deeper, the top of the stack remains generally constant in the same horizontal plane. Compare FIGS. 6 and 7.

The stacker 7 includes discharge means for the stack of sheets, which may be of any suitable type. As shown in FIGS. 1B and 7, the discharge means may include bottom discharge rollers 39 onto which the stack may be rolled for discharge of the stack out of the device. The drive means for discharge would be conventional and is not shown.

One end of the roller platform 35 is provided with a finger 40 which, when the platform raises to the top, actuates a lift sensor 41 of photocell or other suitable type, for purposes to be described.

Figure 5:
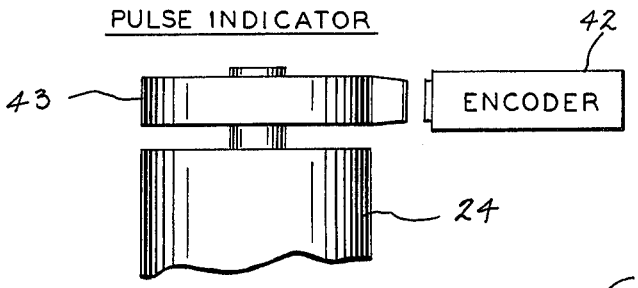
FIG. 5 is an enlarged schematic view of the encoder taken on line 5—5 of FIG. 4.

Also, for purposes to be described, rear shaft 24 of vacuum conveyor section 4 is provided an an encoder 42, as best shown in FIG. 5 and wherein a pulse creating member 43 is mounted to the shaft and pulses the encoder upon each shaft revolution.

Figure 8:
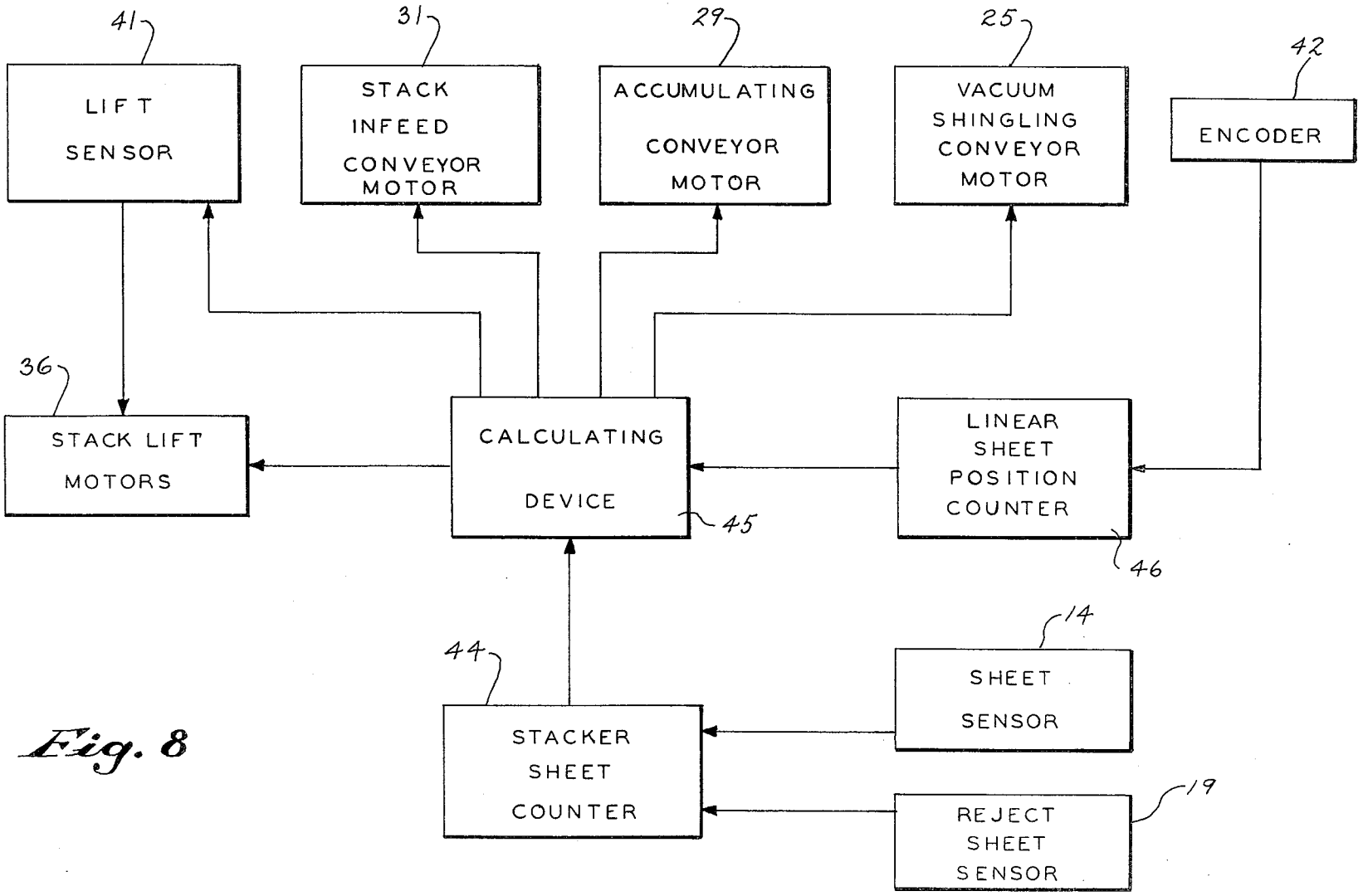
FIG. 8 is a diagrammatic view of the controls for the device.
Figure 9:
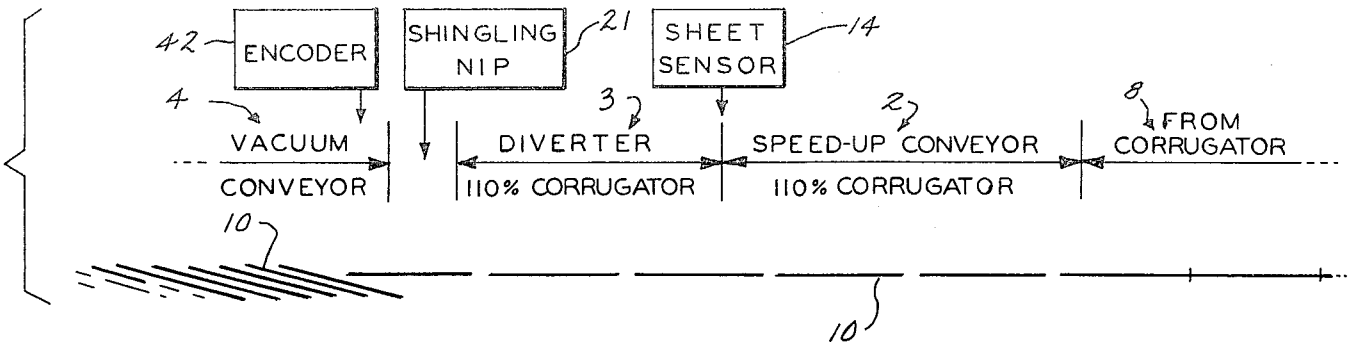
FIG. 9 is a schematic side elevation of the upstream portion of the conveyor line and showing the sheet positions and movement through the various upstream sections.
Figure 10:
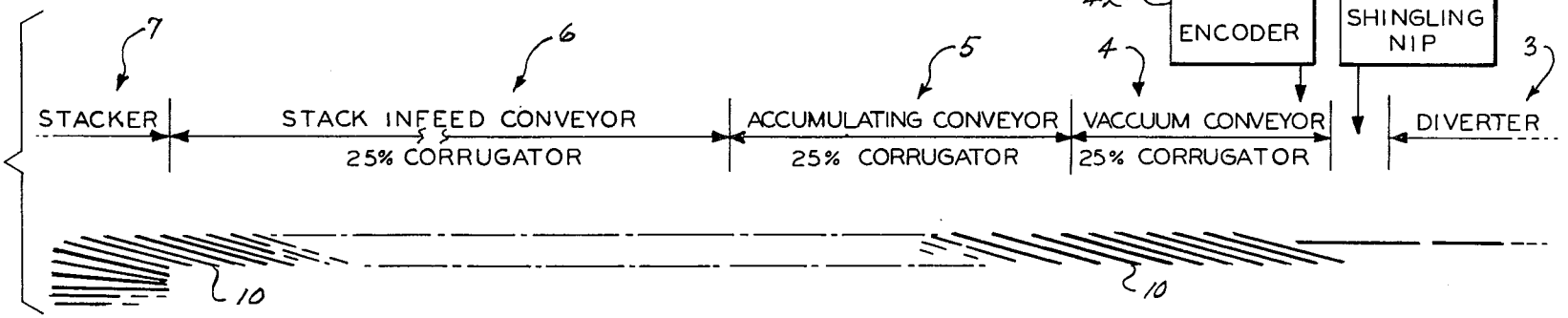
FIG. 10 is a schematic side elevation of the downstream portion of the conveyor line and showing the sheet positions and movement through the various downstream sections during the normal portion of the shingling and stacking run.

Referring to FIG. 8, a diagrammatic showing of the controls is disclosed. Sheet sensor 14 and reject sheet sensor 19 are disclosed to the input of a stacker sheet counter 44 which is set to provide a signal to a suitable calculating and motor actuating device 45 when a preset number of sheets have passed upstream of diverter section 3. If 100 sheets are to be provided in each separate stack, the said signal will be given to the device 45 when the net number of sheets (those passing sensor 14 less those passing sensor 19) equals 100.

In addition, encoder 42 is connected to a linear sheet position counter 46 which is connected through device 45 to motors 25, 29, 31 and 36, which are of the variable speed type. Since all of the conveyors bear a known positional relationship with each other and with the encoder shaft 24, it is possible to know, via the counter 46, exactly where the trailing edge of the last sheet of a batch of 100 is located relative to the conveyors. This is determined through calculating device 45.

Lift sensor 41 is also connected to stack lift motors 36 for determining the upper limit of travel of platform 35.

The above-identified U.S. Pat. No. 3,390,731 discloses a control device involving pulse generators and counters and is incorporated herein by reference.

CYCLE FOR STACK DISCHARGE

Referring to FIGS. 2–4, 6–7 and 9–10, as heretofore described, during normal conveying of sheets 10 to create a stack, the sheets are separated at section 2, diverted if needed at section 3, shingled by a slow down (preferably to about 25% of the speed of section 1) at section 4 and maintained at the same speed and shingle overlap through sections 5 and 6 to stacker 7. Stacker platform motors 36 gradually lower. During this time, the net sheet output through shingling nip 21 is being fed to stacker sheet counter 44 by sheet sensors 14 and 19. If a stack of 100 sheets is desired, when counter 44 counts 100 sheets, it triggers calculating device 45 to begin the stack discharge cycle. During this cycle, all of the sheets 10 downstream from the 100th one counted are moved onwardly in a group to stacker 7 for discharge, while a space is created between the trailing sheet of the downstream 100 and the leading sheet of the next succeeding upstream sheets.

Figure 11:
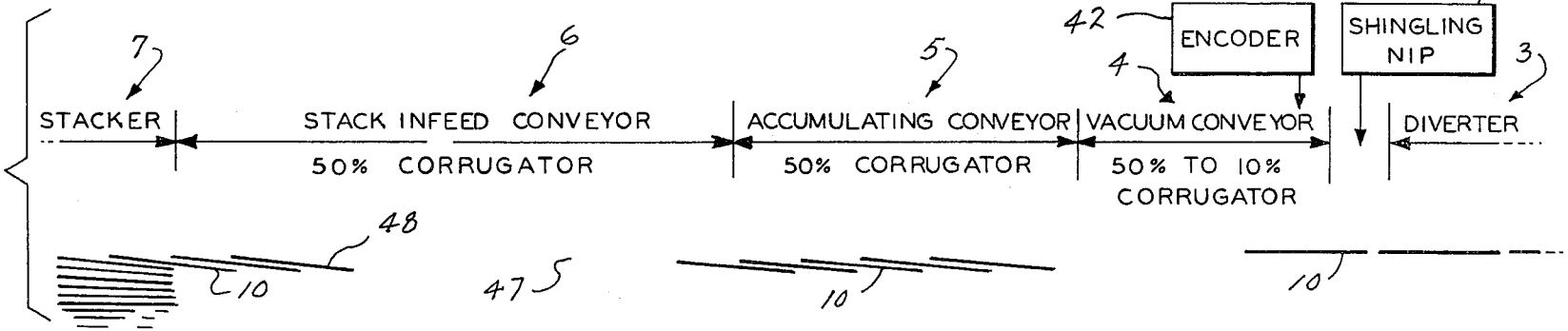
FIG. 11 is a view similar to FIG. 10 during the first phase after the stack discharge cycle is initiated.

When device 45 is triggered, it causes motors 25, 29 and 31 to immediately accelerate to a higher speed which is nevertheless below the speed of input conveyor belt 8. It is contemplated that belts 22, 28 and 30 would approximately double in speed to about 50% of the speed of belt 8. In the preferred example, belts 22, 29 and 30 would thus increase in speed from about 150 ft./min. to about 300 ft./min. The result is shown in FIG. 11, which shows the first phase of the discharge cycle wherein sections 4, 5 and 6 all speed up, and the increased speed at vacuum section 5 causes the sheets 10 to form shingles which now overlap about 50% instead of about 75%. This increase in speed downstream of shingling nip 21 also pulls the downstream 100 away from the upstream sheets to form a gap 47, because conveyor sections 1, 2 and 3 have not speeded up.

Because of the relationship between encoder 42, linear sheet position counter 46 and calculating device 45, it is possible to determine when the trailing edge 48 of the downstream 100 sheets passes any predetermined point along the conveyor line. Thus, when edge 48 clears each of conveyor belts 22, 28 and 30, it is possible to change the speed of the adjacent upstream belt.

It is therefor contemplated that as edge 48 clears vacuum section belt 22, device 45 will slow the latter down to a speed lower than the normal belt speed. In the present instance, it is contemplated to slow belt 22 from about 50% to about 5% of the speed of input belt 8. In the preferred example, belt 22 would be slowed from 300 ft./min. to 30 ft./min. Similarly, when edge 48 clears accumulator section belt 28, the latter will be reduced from about 50% to about 5% of the input belt 8 speed. Likewise, when edge 48 clears stacker infeed section belt 30, the latter will also be similarly reduced in speed.

Figure 12:
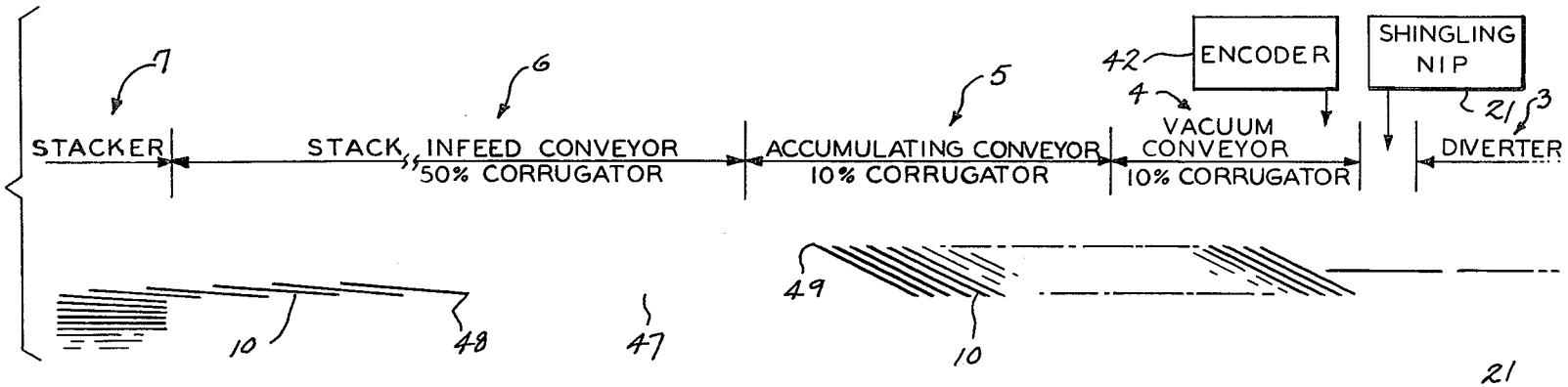
FIG. 12 is a view similar to FIGS. 10 and 11 during subsequent continuation of the discharge cycle.
Figure 13:
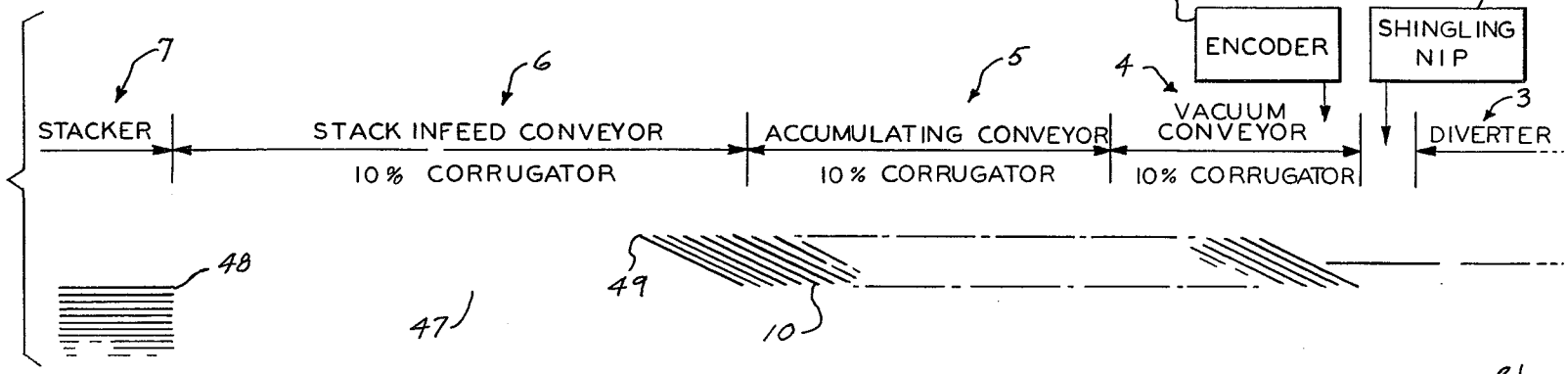
FIG. 13 is a view similar to FIGS. 10–12 when a stack has been completed for discharge.

The conveyor slowdown is therefor in a downstream direction, one-by-one in succession. This is best shown in FIGS. 11–13. Because of the in-line slowdown, gap 47 will gradually widen until the trailing edge 48 is in stacker 7. At the same time, the trailing sheets for the next succeeding stack will, at vacuum section 4, be shingled with an overlap of approximately 95% and travel at the substantially reduced speed down the conveyor.

When edge 48 has cleared infeed belt 30 and is in stacker 7, the vertical stack of 100 is completely formed. Therefor, devices 42, 46 and 45 are programmed to immediately accelerate motors 36 to quickly lower platform 35 for fast discharge of the stack. The platform is then raised again to its uppermost position. During this period, the leading edge 49 of the next succeeding stack gradually closes gap 47 and is timed to reach stacker 7 just in time for receipt by the now raised platform 35. The gap 47 thus functions to permit processing time at the stacker.

Figure 14:
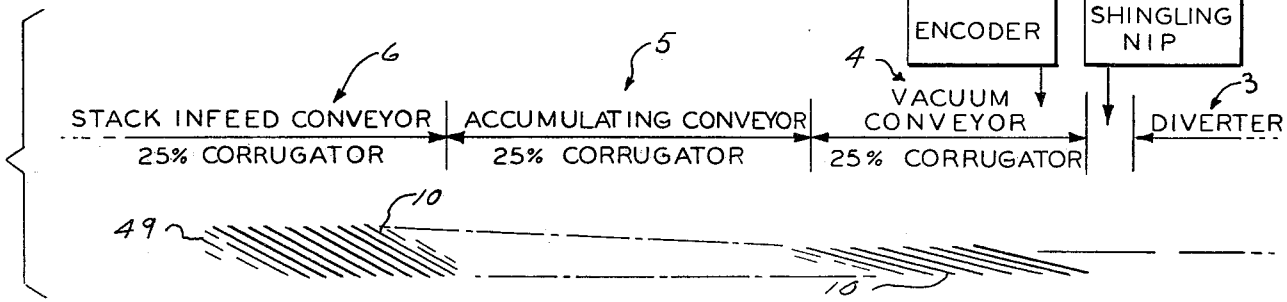
FIG. 14 is a view similar to FIGS. 10–13 at the start-up of conveying the next stack in succession.

When platform 35 reaches to top, finger 40 triggers lift sensor 41 which, in turn, causes motors 36 to start lowering the platform slowly for receipt of the sheets in the next stack to be formed. At the same time, sensor 41 triggers calculating device 45 to slowly accelerate motors 25, 29 and 31 back up so that belts 22, 28 and 30 gradually increase in speed from about 5% of the speed of belt 8 to the original normal 25% thereof. The result is schematically shown in FIG. 14 wherein the shingled overlap is about 95% at the leading portion of the sheets (corresponding to the 5% speed during the discharge cycle), and gradually changes to about 75% (corresponding to the final 25% speed at termination of the discharge cycle).

The new stream of sheets are then built up in the stacker until counter 44 has counted the requisite number of sheets, at which time the automatic cycle repeats itself.

Various types of sheet position sensing devices, counters and variable speed motor actuators, and the interconnections therefor, could be utilized without departing from the spirit of the invention, which provides a unique concept for shingling and stacking of conveyed sheet material.

Various modes of carrying out the invention are contemplated as being within the scope of the following claims particularly pointing out and distinctly claiming the subject matter which is regarded as the invention.

I claim:

1. A method of handling sheets conveyed in succession from a sheet source to a stacker where a vertical stack of a predetermined number of sheets is to be formed, and wherein the sheets being conveyed are in-line and initially traveling at a first speed on an input conveyor, comprising the steps of:

(a) sensing the number of said sheets passing a first location between said input conveyor and said stacker, (b) shingling said sensed sheets at a second location downstream of said first location while slowing the sensed sheets to a second speed, (c) conveying said shingled sheets from said second location to said stacker at said second speed, (d) increasing the speed of all of said shingled sheets to a third speed upon the sensing of said predetermined number of sheets passing said first upstream location to separate said sheets into a stack-forming group, (e) slowing the sheets upstream of said group to a fourth speed in response to the passage of the trailing end of said group by at least one predetermined point, (f) discharging the stack ultimately formed from said group from the stacker, (g) and then increasing the speed of said slowed upstream sheets to said second speed downstream of said second location.

2. The method of claim 1 wherein:

(a) said second speed is below said first speed, (b) said third speed is between said first and second speeds, (c) and said fourth speed is below said second speed.

3. The method of claim 2 wherein:

(a) said second speed is about 25% of said first speed, (b) said third speed is about 50% of said first speed, (c) and said fourth speed is about 5% of said first speed.

4. The method of claim 3 wherein:

(a) said first speed is about 600 ft./min., (b) said second speed is about 150 ft./min., (c) said third speed is about 300 ft./min., (d) and said fourth speed is about 30 ft./min.

5. The method of claim 1:

(a) wherein the area between said first location and said shingler includes a plurality of separate in-line conveyors, (b) and wherein the said upstream sheets are slowed to said fourth speed by slowing each said separate in-line conveyor individually and successively in a downstream direction in response to passage of the trailing end of said group past the end of each respective separate conveyor.

6. The method of claim 5 which includes the steps of:

(a) sensing the passage of the trailing end of said group at said second location, (b) and determining from said last-named sensing step the lineal position of said trailing end when the latter has passed the end of each respective conveyor.

7. The method of claim 6 which includes the steps of diverting undesirable sheets out of the line between said first location and said second location.

8. The method of claim 1:

(a) wherein the step (d) of increasing the shingled sheets to a third speed and the step (e) of slowing the upstream sheets to a fourth speed forms a gap between said group and said upstream sheets, (b) said gap narrowing during the step (f) of discharging the formed stack.

9. In the method of conveying sheets in succession from a first location along a plurality of separate in-line conveyors to a stacker wherein a vertical stack of a predetermined number of sheets is to be formed, and wherein said plurality of conveyors are traveling at the same speed, the steps of:

(a) shingling said sheets as they pass said location to form a group of shingled sheets for stacking, (b) increasing the speed of said group of shingled sheets, (c) and slowing each said separate in-line conveyor individually and seccessively in a downstream direction in response to passage of the trailing end of said group past the end of each respective separate conveyor to thereby slow sheets traveling upstream of said group of sheets.

10. A device for handling sheets conveyed in succession from a sheet source to a stacker where a vertical stack of a predetermined number of sheets is to be formed, and wherein the sheets being conveyed are in-line and initially traveling at a first speed on an input conveyor, comprising in combination:

(a) means for sensing the number of said sheets passing a first location between said input conveyor and said stacker, (b) means for shingling said sensed sheets at a second location downstream of said first location while slowing the sensed sheets to a second speed, (c) means for conveying said shingled sheets from said second location to said stacker at said second speed, (d) means for increasing the speed of all of said shingled sheets to a third speed upon the sensing of said predetermined number of sheets passing said first upstream location to separate said sheets into a stack-forming group, (e) means for slowing the sheets upstream of said group to a fourth speed in response to the passage of the trailing end of said group by at least one predetermined point, (f) means for discharging the stack ultimately formed from said group from the stacker, (g) and means for then increasing the speed of said slowed upstream sheets to said second speed downstream of said second location.

11. The device of claim 10 which includes:

(a) means for sensing the passage of the trailing end of said group at said second location, (b) and means for determining from said last-named sensing means the lineal position of said trailing end when the latter has passed the end of each respective conveyor.

12. The device of claim 10 which includes means for diverting undesirable sheets out of the line between said first location and said second location.

13. In a device for conveying sheets in succession from a first location along a plurality of separate in-line conveyors to a stacker wherein a vertical stack of a predetermined number of sheets is to be formed, and wherein said plurality of conveyors are traveling at the same speed, the combination comprising:

(a) means for shingling said sheets as they pass said location to form a group of shingled sheets for stacking, (b) means for increasing the speed of said group of shingled sheets, (c) and means for slowing each said separate in-line conveyor individually and successively in a downstream direction in response to passage of the trailing end of said group past the end of each respective separate conveyor to thereby slow sheets traveling upstream of said group of sheets.

* * * * *

UNITED STATES PATENT AND TRADEMARK OFFICE

CERTIFICATE OF CORRECTION

PATENT NO. : 4,200,276

DATED : April 29, 1980

INVENTOR(S) : CARL R. MARSCHKE

It is certified that error appears in the above-identified patent and that said Letters Patent are hereby corrected as shown below:

Column 3, Line 21, Delete "the" and substitute therefor ----they-- Column 4, Line 23, Delete "an", first occurrence and substitute therefor ----with---- Column 4, Line 29, Delete "disclosed" and substitute therefor ----connected---- Column 5, Line 58, Delete "to" and substitute therefor ----the----

Signed and Sealed this

*Twelfth* Day of *August 1980*

[SEAL]

*Attest:*

SIDNEY A. DIAMOND

*Attesting Officer*

*Commissioner of Patents and Trademarks*

US004200276B1

REEXAMINATION CERTIFICATE (2087th)

United States Patent [19]

Marschke

[11] B1 4,200,276

[45] Certificate Issued Sep. 14, 1993

[54] SHINGLING AND STACKING OF CONVEYED SHEET MATERIAL

[75] Inventor: Carl R. Marschke, Phillips, Wis.

[73] Assignee: Marquip, Inc., Phillips, Wis.

Reexamination Request:
No. 90/002,940, Jan. 26, 1993

Reexamination Certificate for:

| | |
|---|---|
| Patent No.: | **4,200,276** |
| Issued: | **Apr. 29, 1980** |
| Appl. No.: | **906,059** |
| Filed: | **May 15, 1978** |

Certificate of Correction issued Aug. 12, 1980.

[51] Int. Cl.[5] ..... B65H 29/66
[52] U.S. Cl. ..... 271/279; 271/202
[58] Field of Search ..... 271/202, 258, 265, 270, 271/279, 278, 259, 203; 493/28

[56] References Cited

U.S. PATENT DOCUMENTS

| | | | |
|---|---|---|---|
| 1,936,893 | 11/1933 | Werner et al. | 107/7 |
| 2,309,728 | 2/1943 | Goettsch | 164/61 |
| 2,660,432 | 11/1953 | Wilske et al. | 271/68 |
| 3,115,237 | 12/1963 | Atkins | 198/34 |
| 3,145,828 | 8/1964 | Hawley | 198/34 |
| 3,768,382 | 10/1973 | Zernov et al. | 93/93 |
| 3,791,269 | 2/1974 | Sawada | 93/93 |
| 3,870,139 | 3/1975 | Wagner | 198/34 |
| 3,938,674 | 2/1976 | Kroeze et al. | 214/6 |
| 3,995,540 | 12/1976 | Huiskes | 93/93 |
| 3,998,141 | 12/1976 | Hsiue | 93/93 |
| 4,018,326 | 4/1977 | Hardy | 198/461 |
| 4,040,618 | 8/1977 | Vermes et al. | 271/182 |
| 4,111,411 | 9/1978 | Graves et al. | 271/199 |
| 4,133,523 | 1/1979 | Berthelot | 271/182 |
| 4,200,276 | 4/1980 | Marschke | 271/279 |

OTHER PUBLICATIONS

The Ward/Genco Super Stack, The Ward Machinery Company.

*Primary Examiner*—Richard A. Schacher

[57] ABSTRACT

A conveyor system wherein sheets are conveyed from a cutter or the like at a given speed, are increased in speed before passing through a diverter, are slowed down after passing through a shingling nip to thereby overlap them, and then normally proceed at the latter speed to a stacker which is adapted to stack a fixed number of sheets before discharging the stack. A sheet sensor is disposed upstream of the diverter to count the number of sheets and, when the requisite number of sheets have passed, triggers the cycle for ultimate discharge of all downstream sheets in a single stack. The first phase of the discharge cycle includes speeding up of the conveyor line downstream of the shingling nip to move the downstream sheets away from those upstream which will be disposed in the next succeeding stack. As the trailing end of the group of fast-moving downstream sheets passes selected points, the shingle conveyor sections upstream thereof are slowed to partially delay the sheets which will form the next stack in their movement down the conveyor. When all of the sheets destined for the stack are in the stacker, the stacker is actuated to discharge the stack and thereupon the conveyors downstream of the shingling nip are slowly returned to their original normal speed for conveying the sheets which will form the next succeeding stack.

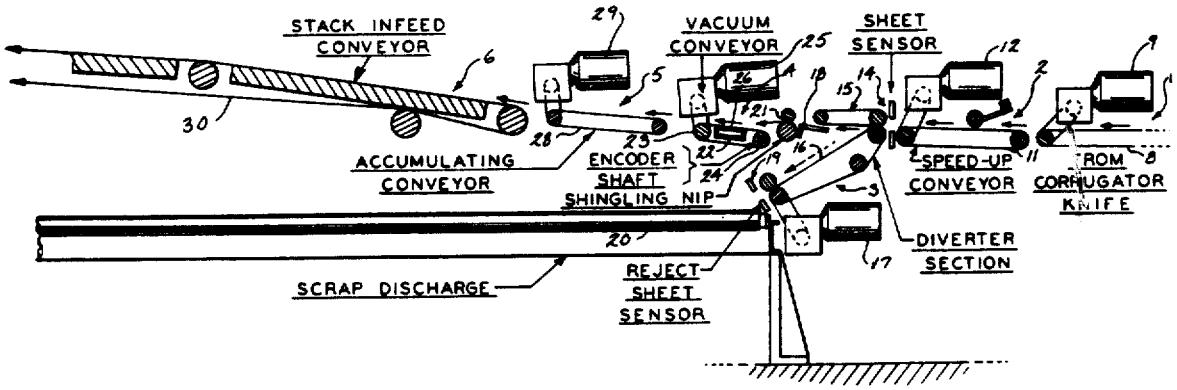

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-13 is confirmed.

* * * * *